US007614669B2

(12) United States Patent
Geringer et al.

(10) Patent No.: US 7,614,669 B2
(45) Date of Patent: Nov. 10, 2009

(54) INTERCHANGEABLE LOCK OPERABLE IN FAIL SAFE OR FAIL SECURE MODES

(75) Inventors: Arthur Geringer, Oak Park, CA (US); David Geringer, Camarillo, CA (US); Richard Geringer, Moorpark, CA (US)

(73) Assignee: Security Door Controls, Westlake Village, CA (US)

( * ) Notice: Subject to any disclaimer, the term of this patent is extended or adjusted under 35 U.S.C. 154(b) by 303 days.

(21) Appl. No.: 11/144,919

(22) Filed: Jun. 3, 2005

(65) Prior Publication Data

US 2005/0225097 A1 Oct. 13, 2005

Related U.S. Application Data

(63) Continuation-in-part of application No. 10/798,495, filed on Mar. 10, 2004.

(51) Int. Cl.
*E05C 1/06* (2006.01)

(52) U.S. Cl. ..... 292/144; 292/DIG. 53; 292/DIG. 54; 292/201; 292/DIG. 64

(58) Field of Classification Search ..... 292/144, 292/169.14, 169.15, 173, 275, 167, DIG. 65, 292/DIG. 66, DIG. 53, DIG. 54, DIG. 201, 292/DIG. 64; 70/277, 283, 279.1, 472, 278.7, 70/461

See application file for complete search history.

(56) References Cited

U.S. PATENT DOCUMENTS

| | | | | |
|---|---|---|---|---|
| 4,017,107 A | | 4/1977 | Hanchett | 292/341.16 |
| 4,133,113 A | * | 1/1979 | Rider | 33/661 |
| 4,429,556 A | * | 2/1984 | Kambic | 70/149 |
| 4,439,808 A | | 3/1984 | Gillham | 361/144 |
| 4,609,910 A | | 9/1986 | Geringer et al. | 340/545 |
| 4,626,010 A | | 12/1986 | Hanchett, Jr. et al. | 292/341.16 |
| 4,652,028 A | | 3/1987 | Logan et al. | 292/251.5 |
| 4,720,128 A | | 1/1988 | Logan, Jr. et al. | 292/251.5 |
| 5,000,497 A | | 3/1991 | Geringer et al. | 292/251.5 |
| 5,484,180 A | | 1/1996 | Helmar | 292/341.16 |
| 5,876,073 A | | 3/1999 | Geringer et al. | 292/144 |
| 5,933,067 A | | 8/1999 | Frolov | 335/251 |
| 6,581,423 B2 | | 6/2003 | Lin | 70/107 |
| 6,732,557 B1 | * | 5/2004 | Zehrung | 70/283 |

* cited by examiner

*Primary Examiner*—Peter M. Cuomo
*Assistant Examiner*—Mark Williams
(74) *Attorney, Agent, or Firm*—Koppel, Patrick, Heybl & Dawson

(57) ABSTRACT

One embodiment of an electric door lock according to the present invention is interchangeable between fail safe and fail secure modes and comprises a housing for receiving the internal components of the door lock. A latch bolt is mounted within the housing and is movable from partially extending from and retracted into the housing. A doorknob is mounted to the housing and is rotatable to retract the latch bolt. A solenoid assembly is also mounted within the housing and can be interchangeably arranged to cause the lock to operate a fail secure mode wherein the doorknob is prevented from retracting the latch bolt when the solenoid is not energized, or a fail safe mode wherein the doorknob is allowed to retract the latch bolt when the solenoid is not energized. The solenoid is nested in place within the housing in both modes.

8 Claims, 8 Drawing Sheets

| LOAD LBS | HELICAL SPRING | CONICAL SPRING |
|---|---|---|
| 0 | 1.12 | 1.12 |
| 0.05 | 1.06 | 1.01 |
| 0.1 | 1.02 | 0.89 |
| 0.15 | 0.96 | 0.77 |
| 0.2 | 0.9 | 0.68 |
| 0.25 | 0.84 | 0.6 |
| 0.3 | 0.78 | 0.53 |
| 0.35 | 0.72 | 0.47 |
| 0.4 | 0.65 | 0.42 |
| 0.45 | 0.59 | 0.38 |
| 0.5 | 0.54 | |
| 0.55 | 0.47 | |
| 0.6 | 0.41 | |

HELICAL SPRING
CONICAL SPRING

INTERCHANGEABLE LOCK OPERABLE IN FAIL SAFE OR FAIL SECURE MODES

The following patent application is a continuation-in-part of U.S. patent application Ser. No. 10/798,495 filed on Mar. 10, 2004.

BACKGROUND OF THE INVENTION

1. Field of the Invention

The present invention relates to door locks, and in particular to electric door locks that can be operated in both the fail-safe and fail-secure mode and comprises improvements to increase the operating life of the lock.

2. Description of the Related Art

Security doors to prevent theft or vandalism have evolved over the years from simple doors with heavy duty locks to more sophisticated egress and access control devices. Hardware and systems for limiting and controlling egress and access through doors are generally utilized for theft-prevention or to establish a secured area into which (or from which) entry is limited. For example, stores use such secured doors in certain departments (such as, for example, the automotive department) which may not always be manned to prevent thieves from escaping through the door with valuable merchandise. In addition, industrial companies also use such secured exit doors to prevent pilferage of valuable equipment and merchandise.

One type of door lock which has been used in the past to control egress and access through a door is an electromagnetic system which utilizes an electromagnet mounted on a door jamb, with an armature mounted on the door held by the electromagnet to retain the door in the closed position when the electromagnet is actuated. Such locking mechanisms are illustrated in U.S. Pat. No. 4,439,808, to Gillham, U.S. Pat. No. 4,609,910, to Geringer et al., U.S. Pat. No. 4,652,028, to Logan et al., U.S. Pat. No. 4,720,128 to Logan, Jr., et al., and U.S. Pat. No. 5,000,497, to Geringer et al. All of these references utilize an electromagnet mounted in or on a door jamb and an armature on the door held by the electromagnet to retain the door in the closed position. Such electromagnetic locking systems are quite effective at controlling egress and access through the door they are installed on. Unfortunately, however, such systems are quite expensive, and require a fairly complex installation, often with the electromagnet being mounted in the door jamb.

Another type of system which is known in the art is the electric door strike release mechanism, in which a latch bolt located in and extending from a locking mechanism located in a door is receivable in an electrically operable door strike mounted in the frame of the door. The door may be opened either by retracting the latch bolt into the locking mechanism to thereby disengage it from the door strike, or by electrically actuating the door strike mechanism to cause it to open and to thereby release the extended latch bolt from the door strike mechanism. Typically, such electrically operable door strikes pivot to allow the door to close without the door strike mechanism being electrically actuated. Such door strike mechanisms are illustrated in U.S. Pat. No. 4,017,107, to Hanchett, U.S. Pat. No. 4,626,010, to Hanchett et al., and in U.S. Pat. No. 5,484,180, to Helmar. Like the electromagnet/armature systems discussed above, electrically operated door strike systems are also expensive, and require a significant installation into the door jamb, which must usually be reinforced.

Electrically operable door locks have also been developed that can be installed on a door through which access is to be controlled by an electrically operable security system. Such a lock is disclosed in U.S. Pat. No. 5,876,073 to Geringer et al. The door opening mechanism of the door lock is selectively locked and unlocked by controlling the supply of electricity to the door lock to thereby control access or egress through the door. The electrically operable door lock uses an electromagnetic actuator to drive a locking member between a locked position in which it engages a latch actuating member to prevent it from being rotated to retract a latch bolt to open a door, and an unlocked position in which it is disengaged from the latch actuating member to allow it to be rotated to retract the latch bolt to open the door. By reversing the position of the electromagnetic actuator in the door lock apparatus, the system may operate in either a fail secure mode in which the electromagnetic actuator must be powered to unlock the door, or a fail safe mode in which the electromagnetic actuator must be powered to lock the door.

A universal solenoid actuator has been developed for use in either a fail-safe or a fail-secure lock mechanism or a push-type or pull-type mechanism and comprises a reversible coil assembly. Such an actuator is disclosed in U.S. Pat. No. 5,933,067 to Frolov. It includes at least one plunger and a module for receiving electricity from a power supply and delivering the electricity to the coil assembly. The coil assembly includes a housing which defines a bore extending through the coil assembly, at least one coil surrounding the bore and first and second fittings at opposed ends of the bore. The plunger is received within the bore and is actuated upon application of an electrical potential to the coil assembly. When used with a fail-safe lock, the first fitting is affixed to the lock. When used with a fail-secure lock, the coil assembly is reversed to affix the second fitting to the lock. The coil assembly is terminated at opposite ends for first and second threaded fittings that are sized and shaped to be affixed to conventional lock mechanisms by merely threading the coil assembly into the locking mechanism. Whichever of the first and second fittings is not affixed to a lock mechanism can receive a threaded connector to deliver electricity to the coil assembly.

A door lock has also been developed in which an outside knob assembled at the outside of a door can be manually controlled to be operationally associated with or dissociated from the door lock. Such a lock is described in U.S. Pat. No. 6,581,423 to Lin. When the door lock is fastened, the outside knob can be selectively decoupled from the door lock and become idle. The lock utilizes a manually-operable controller that is shaped as a seesaw button that protrudes partially from the lock's flange plate. By manually operating the button the outside knob is selectively decoupled. This helps prevent the door lock from being damaged if a force is exerted on the doorknob by external impact or by forcible turning.

SUMMARY OF THE INVENTION

One embodiment of an electric door lock according to the present invention is interchangeable between fail safe and fail secure modes and comprises a housing for receiving the internal components of the door lock. A latch bolt is mounted within the housing and is movable between partially extended from and retracted into the housing. A doorknob, lever, handle, or other means for turning the components of a lock (hereinafter referred to as a "doorknob"), is mounted to the housing and is rotatable to retract the latch bolt. A solenoid assembly is also mounted within the housing and can be interchangeably arranged to cause the lock to operate in a fail secure mode wherein the doorknob is prevented from retracting the latch bolt when the solenoid is not energized, or a fail safe mode wherein the doorknob is allowed to retract the latch bolt when the solenoid is not energized. The solenoid is nested in place within the housing in both modes.

Another embodiment of an electric door lock according to the present invention is interchangeable between fail safe and fail secure modes, and also comprises similar housing, latch bolt, and doorknob. A solenoid assembly is mounted within the housing and comprises a solenoid body, plunger and rod/tip assembly. The plunger is movably mounted within and drawn into the solenoid body when the solenoid assembly is energized. The rod/tip assembly is capable of being mounted to either end of the plunger to interchange the solenoid assembly to cause the lock to operate in a fail safe or fail secure mode.

Still another embodiment of an electric door lock according to the present invention is interchangeable between fail safe and fail secure modes, and also comprises a similar housing, latch bolt and doorknob. A solenoid assembly is mounted within the housing. A hub mechanism is also mounted within the housing with the doorknob mounted thereto. A coupling member is held within the housing and movable between a first coupling position to allow the hub mechanism to rotate when the doorknob is rotated, or a second coupling position wherein the hub mechanism is not allowed to rotate when the doorknob is rotated. The hub mechanism retracts the latch bolt when the hub mechanism is rotated. A locking lever is also mounted within said housing and operably arranged between the solenoid assembly and the coupling mechanism. The locking lever is movable by the solenoid assembly between first and second locking lever positions, which cause the coupling mechanism to move between the first and second coupling positions.

One embodiment of a solenoid assembly according to the present invention comprises a solenoid body having a longitudinal bore and a coil surrounding the longitudinal bore. Electrical conductors are included to apply an electrical signal to the coil. A plunger is movably arranged within the longitudinal bore and drawn into the solenoid housing when the coil is energized. A rod/tip assembly is mounted to the plunger and a conical spring is mounted between the rod/tip assembly and the solenoid body. The conical spring is compressed when the plunger is drawn into the solenoid body, the conical spring urging the rod/tip assembly to extend from the solenoid body when the coil is not energized.

These and other features and advantages of the invention will be apparent to those skilled in the art from the following detailed description, taken together with the accompanying drawings, in which:

BRIEF DESCRIPTION OF THE DRAWINGS

FIG. 5 is a sectional view of the solenoid in FIG. 4, assembled and with power on;

FIG. 8 is a sectional view of the solenoid of FIG. 7, assembled and with power on;

FIG. 18 is a plan view of the lock in FIG. 3, with power on;

DETAILED DESCRIPTION OF THE INVENTION

The inventions herein are described with reference to a particular lock but it should be understood that the inventions can be similarly used in other types of locks and other devices unrelated to locks. The components described herein can have many different shapes and sizes beyond those shown and can be arranged in many different ways beyond those described herein.

Figure 2:
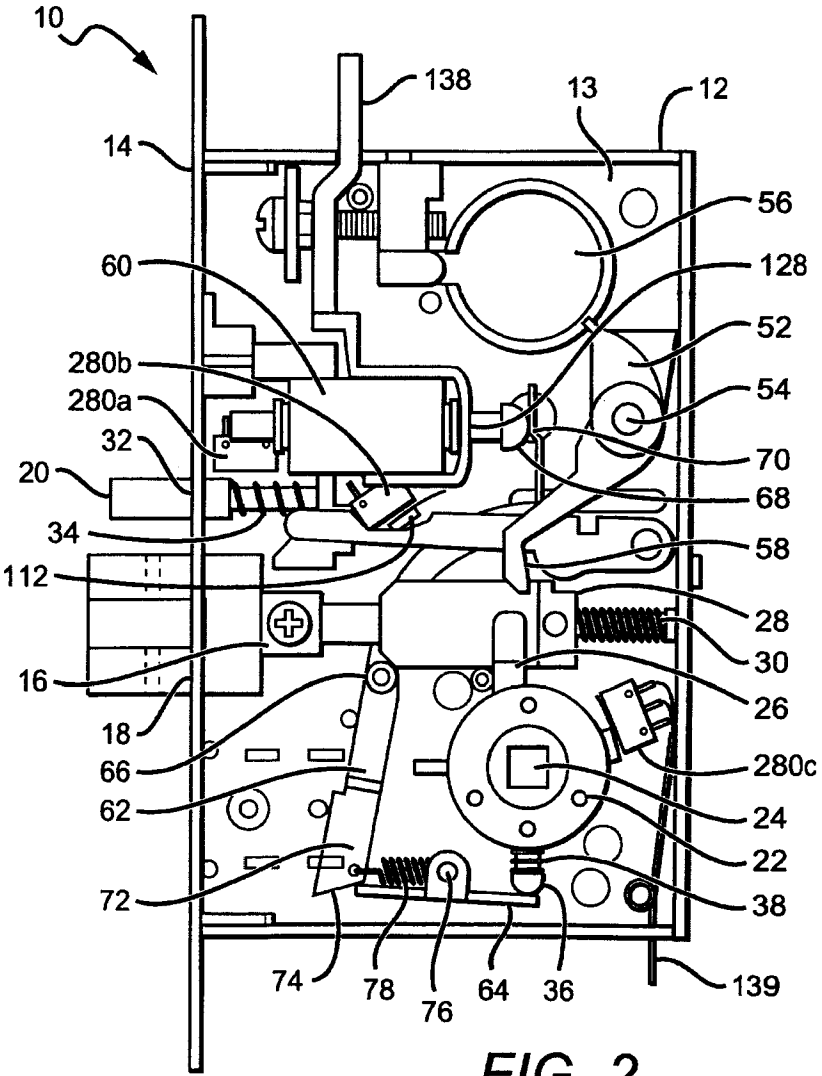
FIG. 2 is a plan view of the lock in FIG. 1, operating in the fail safe mode.
Figure 1:
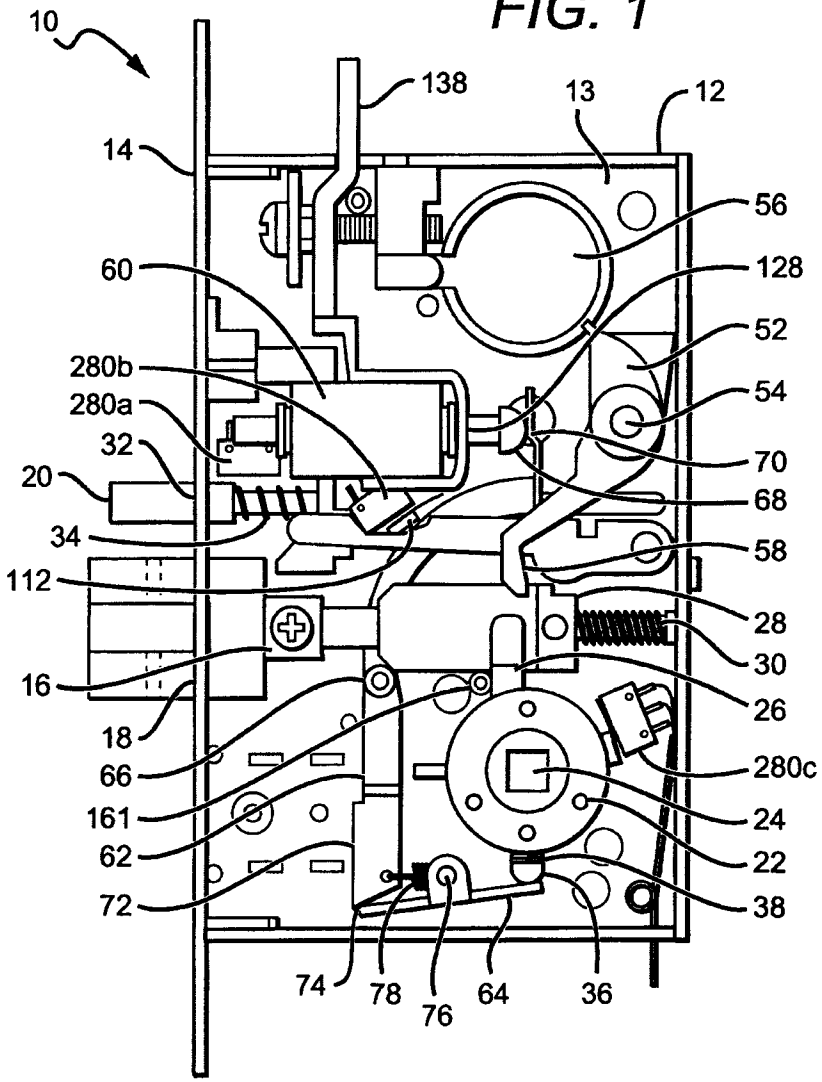
FIG. 1 is a plan view of one embodiment of a lock according to the present invention operating in the fail secure mode, with its cover removed so that its internal components are visible.

FIGS. 1 and 2 show one embodiment of a lock 10 according to the present invention that can be quickly and easily changed to operate in either the fail safe mode or fail secure mode. It is generally understood in the industry that the fail safe mode of a lock describes a mode wherein the door can be opened by the lock doorknob when power to the lock is turned off or interrupted (i.e. power failure). Conversely, the fail secure mode describes a mode wherein the door cannot be opened by doorknob when power to the lock is off or lost.

The lock 10 generally comprises a housing 12 that can be many different shapes and sizes, but has a height, width and depth so that it can be mounted within a door and hold the internal lock components described below. The housing 12 comprises a back plate 13 and is shown in FIGS. 1 and 2 with its front plate removed so that the internal lock components are shown. When the lock 10 is finally assembled, the front plate is installed such that the housing 12 fully surrounds and holds the internal lock components. The housing 12 includes a front plate 14 that is arranged so that when the lock 10 is installed in the door, the front plate 14 is flush with the leading edge of the door.

Figure 3:
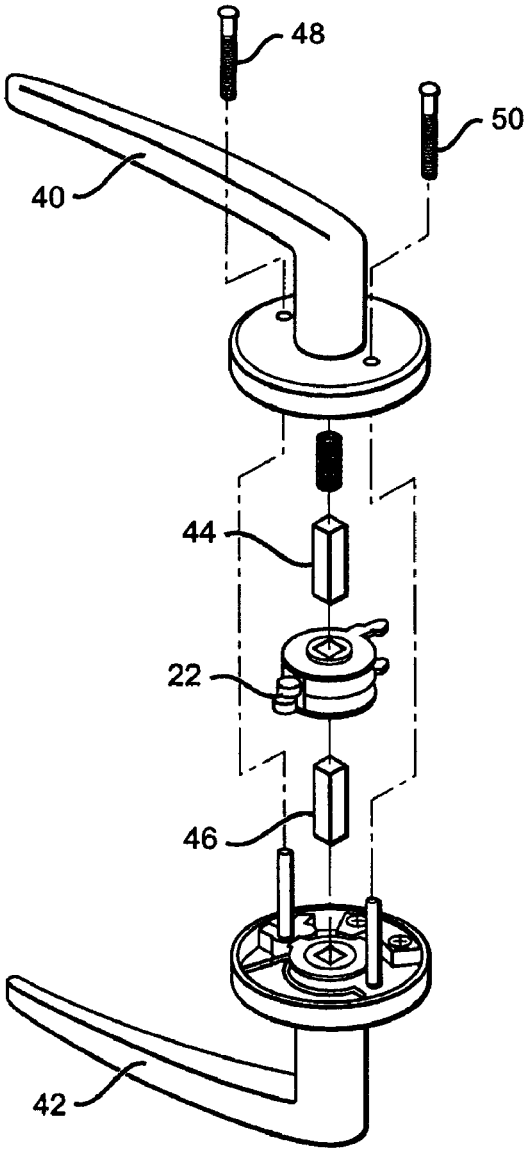
FIG. 3 is an exploded perspective view of the handle and hub mechanism used in the lock of FIGS. 1 and 2.

A latch bolt 16 is mounted within the housing 12 and can be driven by a doorknob (shown in FIG. 3). As shown, the front portion of the latch bolt 16 extends through a bolt opening 18 in the flange plate 14 in its extended position and is arranged to engage a strike plate (not shown) in a door frame. The latch bolt 16 can also be retracted such that all or most of the latch bolt's front portion is retracted into the housing 12. In practical use, door lock 10 is mounted in a door to allow a user to operate a doorknob and the latch bolt 16 releases the door. When the door is locked by the door lock 10 the latch bolt 16 extends from front flange plate 14 to engage a strike plate. When the door can be opened, the latch bolt 16 is retracted and disengages from the strike plate.

A hub mechanism 22 is mounted within the housing 12, below the latch bolt 16, and has a handle aperture 24 to receive a spindle 44, 46 as shown in FIG. 3. As further described below and illustrated in FIG. 3, a force generated by turning the doorknob is transferred to the hub mechanism 22 for driving the latch bolt 16 between its extended and retracted positions. The hub mechanism 22 comprises a latch bolt finger 26 that extends from the hub mechanism and cooperates with fused link latch bolt retractor 28 that is integral with the latch bolt 16. As the doorknob turns the hub mechanism 22, the finger 26 also rotates. As the finger 26 rotates towards the back of the housing 12, opposite the front plate 14, the latch bolt 16 is retracted against the force of latch bolt spring 30. When the hub mechanism is rotated back, force of spring 30 urges the latch bolt 16 to its extended position.

An auxiliary latch 20 is mounted within the housing 12 parallel to the latch bolt 16, and comprises a front portion that extends from a safety bolt opening 32 in the front plate 14. The auxiliary latch 20 is urged by safety bolt spring 34 to the extended position, and the auxiliary latch 20 can be moved to a retracted position within the housing 12, against the force of spring 34, by a force applied to the end of auxiliary latch 20. The operation of auxiliary latch 20 and spring 34 cooperate to hold the latch bolt 16 at a predetermined position. In one embodiment according to the present invention, the auxiliary latch 20 is arranged such that when in its retracted position, the latch bolt 16 can only be retracted by the inside doorknob and the key cylinder. When the auxiliary latch 20 is in its extended position, the latch bolt 16 can be retracted. In operation, when the door is closed, the auxiliary latch 20 can be compressed by the frame of the door or the strike plate, and holds the latch bolt 16 at its extended position such that the latch bolt 16 is blocked against operation driven by the doorknob.

The hub mechanism 22 comprises a coupling member 36 that can be moved between an extended position as shown in FIG. 2 and a retracted position as shown in FIG. 1. The coupling member 36 is urged to its extended position by coupling spring 38. When the coupling member 36 is in its retracted position, the hub mechanism 22 can be rotated by the force of a doorknob. Conversely, when the coupling member is in the extended position, the hub mechanism 22 cannot be rotated. As fully described below, it is the operation of the coupling mechanism 36, in cooperation with a solenoid, that allows the lock 10 to operate in both the fail safe and fail secure modes.

FIG. 3 shows the hub mechanism 22 separate from the housing 12 and the other lock components, to illustrate the connection of the first and second doorknobs 40, 42 to the hub mechanism 22. It is understood that the doorknobs 40, 42 are coupled to the hub mechanism 22 in the same fashion when the hub mechanism 22 is in an assembled lock, with the doorknobs 40, 42 being on opposite sides of the housing 12. The first doorknob 40 is mounted to hub mechanism 22 by a first spindle 44 and similarly, the second doorknob 42 is mounted to the hub mechanism 22 by a second spindle 46. The doorknobs 40, 42 are then connected to each other and the hub mechanism 22 by first and second doorknob screws 48, 50 that pass through holes in the first doorknob 40, pass through the housing 12 and mate with threaded holes in doorknob 42.

Referring again to FIGS. 1 and 2, the lock 10 also comprises a bolt lever 52 that can also be operated about bolt lever pin 54 to retract the latch bolt 16. A key cylinder (not shown) can be mounted within cylinder opening 56, such that when the proper key is inserted in the key cylinder and rotated, the bolt lever 52 is rotated about the bolt lever pin 54. A bolt lever finger 58 operates on the latch bolt retractor 28 to retract the latch bolt.

According to the present invention, the lock 10 also comprises a solenoid 60, a locking lever 62, and a rocker arm 64 that cooperate with coupling member 36 to allow one or both of the doorknobs 40, 42 to retract the latch bolt. Many different solenoids can be used in lock 10 including single or multiple stage coils that are operable with different voltages, such as 12 or 24 volts.

Locking lever 62 is mounted to the housing 12 by locking lever pin 66, with the solenoid 60 mounted at one end of the lever 62 and the rocker arm 64 mounted at the other end. The solenoid 60 includes a rod/tip assembly 68 that is mounted to the solenoid's internal plunger. As described below in FIGS. 4-9, depending on how the rod/tip assembly 68 and plunger are arranged, the rod/tip assembly 68 either retracts or extends from the solenoid 60 when the solenoid 60 is energized and correspondingly extends or retracts when the solenoid 60 is not energized. The extension and retraction action causes the solenoid end 70 of the lever 62 to move back or forth, causing the lever arm to rotate about its lever pin 66. This in turn causes the rocker arm end 72 of the lever 62 to move back or forth.

The lever's rocker arm end 72 has a slider surface 74 that cooperates with the rocker arm 72 to extend or retract the coupling member 36. As the rocker arm end 72 moves toward the back of the housing 12, opposite the front plate 14, the end of the rocker arm 64 in contact with the slider surface 74 slides up the surface 74. This causes the rocker arm 64 to rotate about the rocker arm pin 76 and push the coupling member 36 to its retracted position wherein the door handles cannot turn the hub mechanism. When the rocker arm end 72 moves toward the front plate 14, the rocker arm 64 rotates the opposite direction around rocker arm pin 76, allowing the coupling member 36 to move to its extended position, wherein the doorknobs can turn the hub mechanism 22. The rocker arm 64 is held in contact with the slider surface 74, by rocker arm spring 78 that runs between the rocker arm 64 and the lever's rocker arm end 72.

Figure 4:
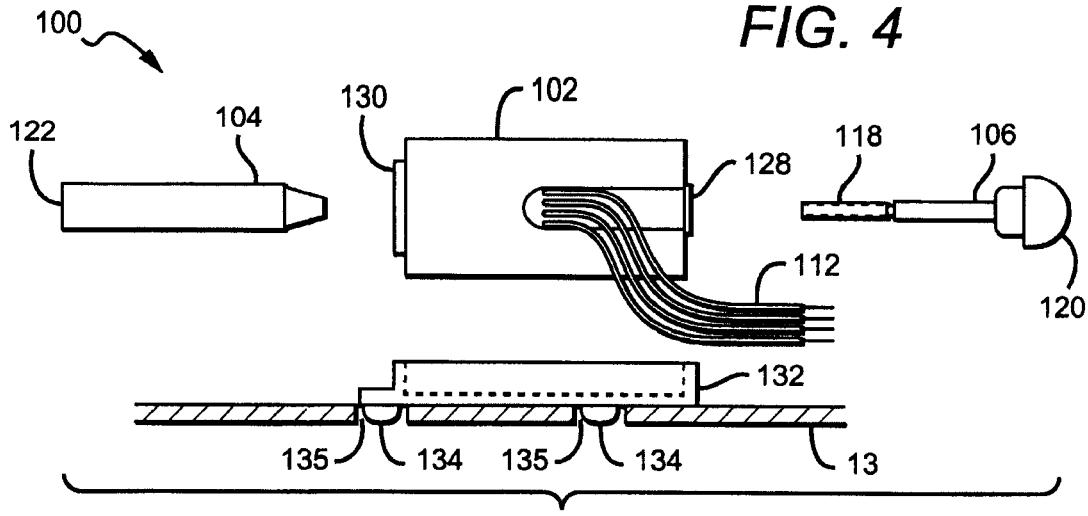
FIG. 4 is an exploded view of one embodiment of an interchangeable solenoid and its mounting cradle according to the present invention, in the fail safe mode.
Figure 5:
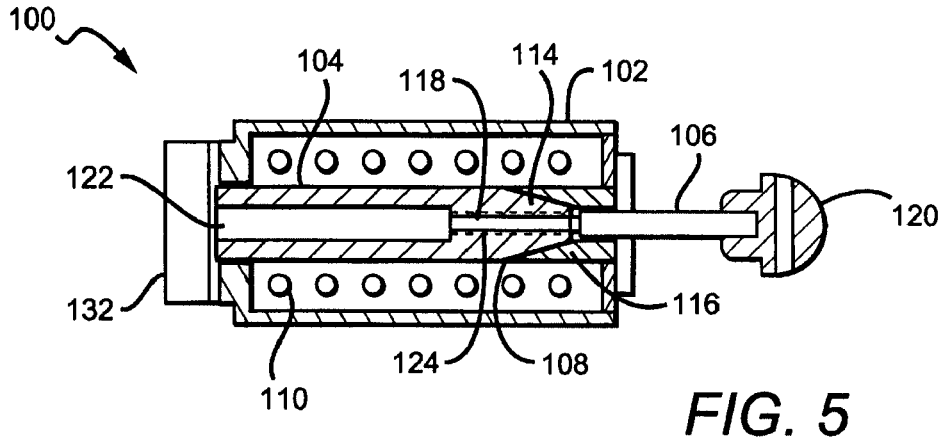
Figure 6:
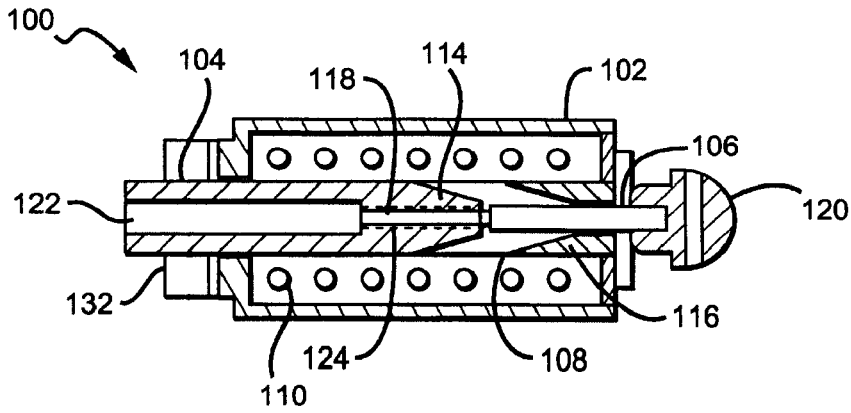
FIG. 6 is a sectional view of the solenoid in FIG. 4, assembled and with power off.

FIGS. 4-6 show one embodiment of a solenoid assembly 100 according to the present invention that can be used in lock 10 described above, as well as many other types of locks. Solenoid assembly 100 generally comprises a solenoid body 102, plunger 104 and a rod/tip assembly 106 (referenced as 68 above). The solenoid body 102 has a generally cylindrical shape and comprises a longitudinal bore 108 sized to receive the plunger 104. The solenoid body 102 also typically comprises at least one coil 110 surrounding the bore 108 and electrical conductors 112 to apply an electric signal to the coil 110. The plunger 104 is arranged within the bore 108 such that the plunger's tapered end 114 fits within the bore's tapered end 116. When an electrical signal is applied to the coil 110 over conductors 112 a magnetic field is created that draws the plunger 104 into the bore 108 such that the plunger's tapered end 114 is within the bore's tapered end 116.

The rod/tip assembly 106 has a lower threaded section 118 on one end and a hemispheric tip 120 at the other. The plunger 104 also has a longitudinal bore 122 that has a bore threaded section 124 at the plunger's tapered end 114. As more fully described below, the lower threaded section 118 mates with the bore threaded section 124 when the rod/tip assembly 106 is mounted to the plunger 104.

As shown in FIGS. 4-6, when the lock 10 shown in FIGS. 1 and 2 is to be configured in the fail safe mode, the plunger 104 is inserted into the plunger's longitudinal bore 122. The rod/tip assembly 106 is inserted into the solenoid's longitudinal bore 108 through a first solenoid opening to be mounted to the plunger. The lower threaded section 118 is threaded into the bore threaded section 124 through the opening of the plunger's longitudinal bore 122 at the plunger's tapered end. As shown in FIG. 5, when power is applied to the solenoid assembly 100, the plunger is drawn fully into the solenoid bore 108 such that the rod/tip assembly extends from the solenoid bore 108. As shown in FIG. 6, when power is off (such as in a fail safe condition) the plunger 104 moves back from its fully drawn position such that the rod/tip assembly 106 is partially drawn within the longitudinal bore 108.

According to the present invention, the solenoid assembly is not fixed in the housing 12 shown in FIGS. 1 and 2. The solenoid does not comprise screws, bolts or welds, but is instead "nested" within the housing 12 between the surfaces of the housing. In one embodiment, the back plate 13 or front plate can comprise an opening or indentation to hold the solenoid body 102 with the solenoid body 102 held between the back and front plates, in the opening indentation.

In another embodiment according to the present invention, a solenoid cradle 132 is provided to hold the solenoid body 102. The cradle 132 is at least partially hollow and shaped to accept the solenoid body 102 and comprises a bottom surface and four walls. The solenoid body 102 rests within the cradle with the walls preventing sideways or front and back movement of the solenoid body 102. The solenoid body 102 is held in the cradle 132 between the back plate and cover plate in an opening/indentation to hold the solenoid body in the housing. The cradle 132 can be held in place in many different ways, such as the cradle 132 resting in a opening/indentation in one of the housing walls. In another embodiment according to the present invention, the cradle rests in the back plate 13 of the housing 12 by mounting posts 134 that are inserted into mounting holes 135 of the back plate 13. When the lock is assembled and the housing cover plate is in place, the solenoid cover plate blocks the solenoid body 102 from moving out of the cradle 132. The solenoid body is held in place between the cradle bottom surface and the housing cover plate, and the cradle walls. By utilizing this cradle arrangement, the solenoid assembly 100 can be easily removed to have its mode changed, and then placed back in the cradle. This arrangement avoids the time and inconvenience of having to remove and replace a solenoid that is fixed to the lock housing by screws, bolts, welds, etc.

Figure 7:
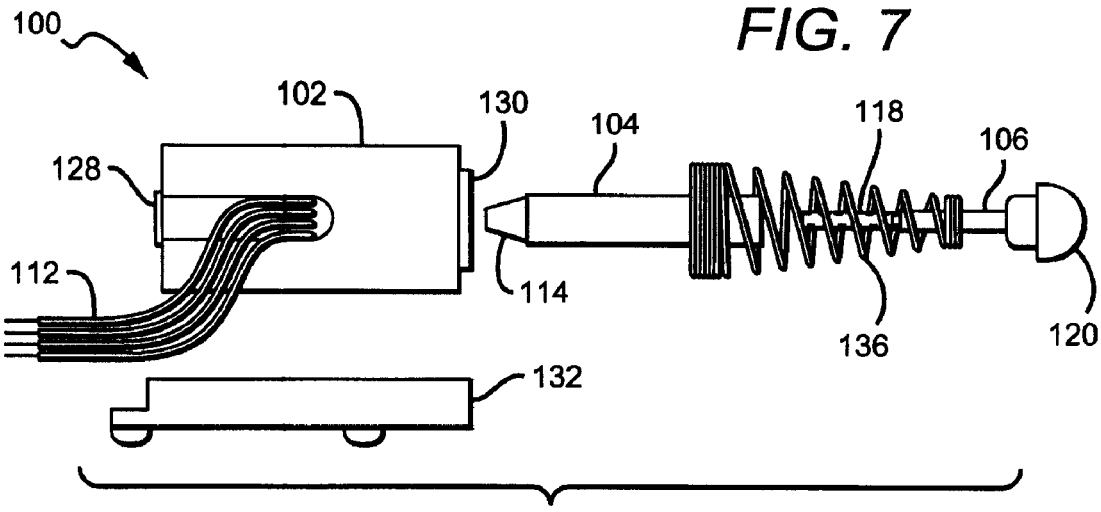
FIG. 7 is an exploded view of the interchangeable solenoid and mounting cradle of FIG. 4, in the fail secure mode.
Figure 8:
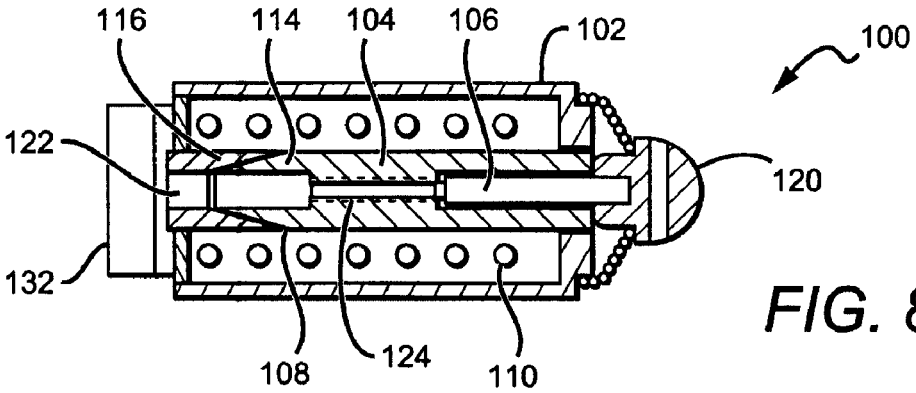
Figure 9:
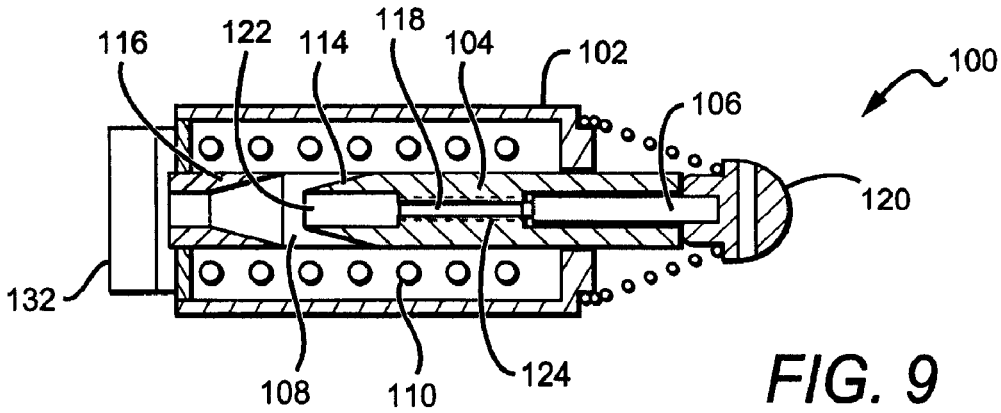
FIG. 9 is a sectional view of the solenoid of FIG. 7, assembled and with power off.

FIGS. 7-9 show the solenoid assembly 100 arranged in the fail secure mode. Converse to the fail safe arrangement in FIGS. 4-6, the rod/tip assembly 106 is inserted into the plunger's longitudinal bore 122 in the opening opposite the plunger's tapered end 114. Except for the hemispheric tip 120, most of rod/tip assembly 106 is arranged within the bore 122, and the lower threaded section 118 mates with the bore's threaded section 124. The plunger 104 is then inserted into the solenoid body 102 through a second solenoid opening 130 that is opposite the first solenoid opening 128.

A solenoid spring 136, having a conical shape, is mounted on the plunger 104 between the solenoid body 102 and the hemispheric tip 120, to urge the plunger to extend from the solenoid body 102. Many different springs can be used having many different longitudinal and cross-section shapes, such as conventional helical springs, with a preferred spring having a conical longitudinal shape that provides advantages over conventional springs as described below in FIGS. 12 and 13. As best shown in FIG. 8, when power is applied to the solenoid body 102 through conductors 112, the coil 110 generates a magnetic field that draws the plunger 104 into the longitudinal bore 108. The spring 136 is compressed between the surface of the solenoid body 102 and the hemispheric tip 120. As best shown in FIG. 9, when power to the coil is off (or lost) the coil no longer generates a magnetic field. The plunger 104 is free to slide along the longitudinal bore 108 and the conical spring 136 urges the plunger 104 to extend from the second solenoid opening 130. For the arrangement of the solenoid 100 as shown in FIGS. 7-9, the plunger 104 and rod tip assembly 106 combination extends from the solenoid body 102 when power is lost.

Referring to FIG. 7, in the arrangement for solenoid 100 the solenoid body 102 is mounted in the same cradle 132 used to hold the solenoid arrangement of FIG. 4. However, in the arrangement of FIG. 7, the solenoid body 102 is arranged opposite that of the solenoid body 102 in FIG. 4, with the second opening 130 on the opposite side of the cradle 132. The change in the orientation of the solenoid body 102 can be accomplished by simply lifting the solenoid body 102 out of the cradle 132, rotating it 180 degrees, and replacing it in the cradle 132. The solenoid body 102 in FIG. 7 is held in the cradle 132 between the cradle bottom surface, the housing cover plate, and the cradle walls.

Figure 10:
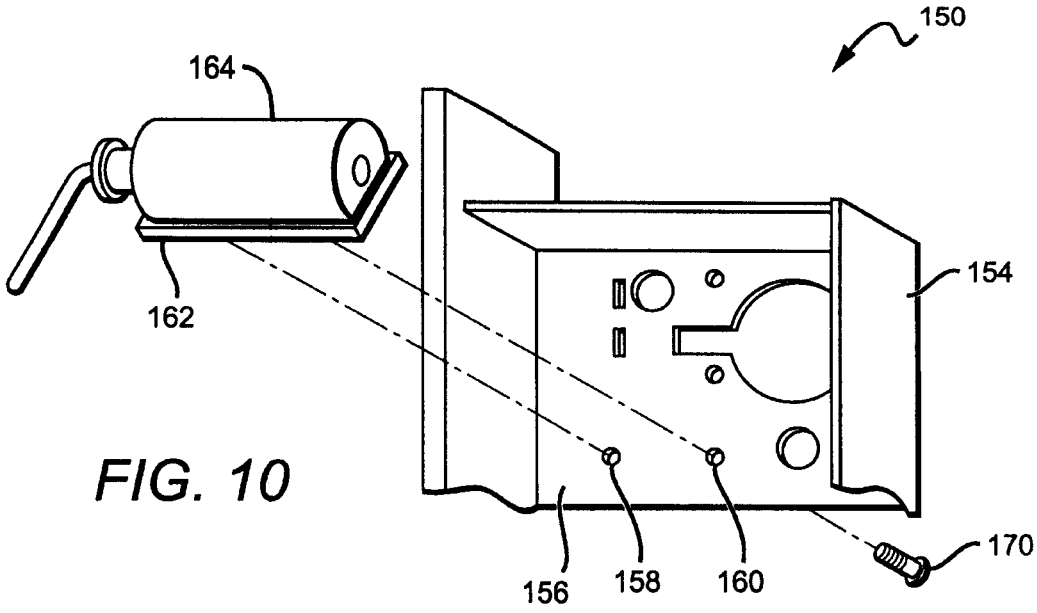
FIG. 10 is an exploded perspective view of another embodiment of a solenoid and cradle arrangement according to the present invention.
Figure 11:
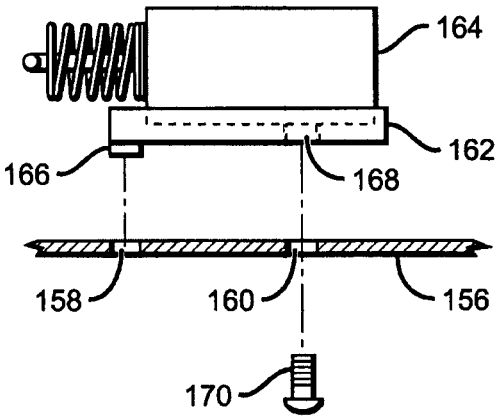
FIG. 11 is a side view of the solenoid and cradle arrangement of FIG. 10.
Figure 12:
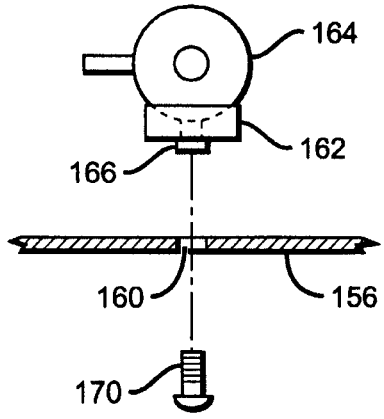
FIG. 12 is an end view of the solenoid and cradle arrangement of FIG. 10.

FIGS. 10-12 show another embodiment of a solenoid assembly and cradle arrangement that can be utilized in different embodiments of a lock 150 according to the present invention. For ease of understanding and description the lock 150 is shown with only some of its components and in a partial cutaway, but it is understood that the lock 150 includes additional components that are the same or similar to those described above in lock 10. The lock 150 comprises a housing 154 with a back plate 156 having first and second back plate holes 158, 160. The lock also includes a cradle 162 and a solenoid assembly 164 similar to the cradle 132 and solenoid assembly 100 described above. The cradle 162 is held in place at the back plate 156 and the solenoid assembly 164 is sized so that it fits within the cradle 162. The solenoid assembly 164 is then nested within the housing 154 and held in place between the surfaces of the cradle 162 and one of the surfaces of the housing 154, preferably the cover plate (not shown).

The cradle 162 comprises another embodiment of an arrangement that allows it to be held securely in the housing 154. Instead of having two mounting posts that are inserted into the first and second back plate holes 158, 160, the cradle has a single mounting post 166 (shown in FIGS. 11 and 12) that is inserted into either one of the first or second back plate holes 158, 160, with the cradle 162 shown with the post 166 in the first hole 158. The cradle 162 also has a threaded hole 168 that is spaced from the mounting post 166 so that it aligns the one of the first and second back plate holes 158, 160 not having the mounting post 166; the second plate hole in this case. The lock 150 also has a mounting screw 170 sized to fit through the second back plate hole 160 and is threaded to mate with the threaded hole. The screw 170 passes through the second hole 160 and is turned into the threaded hole 168 to hold the cradle in place. The solenoid assembly 164 can then be held firmly in place within the cradle 162 by the cover plate.

Figure 13:
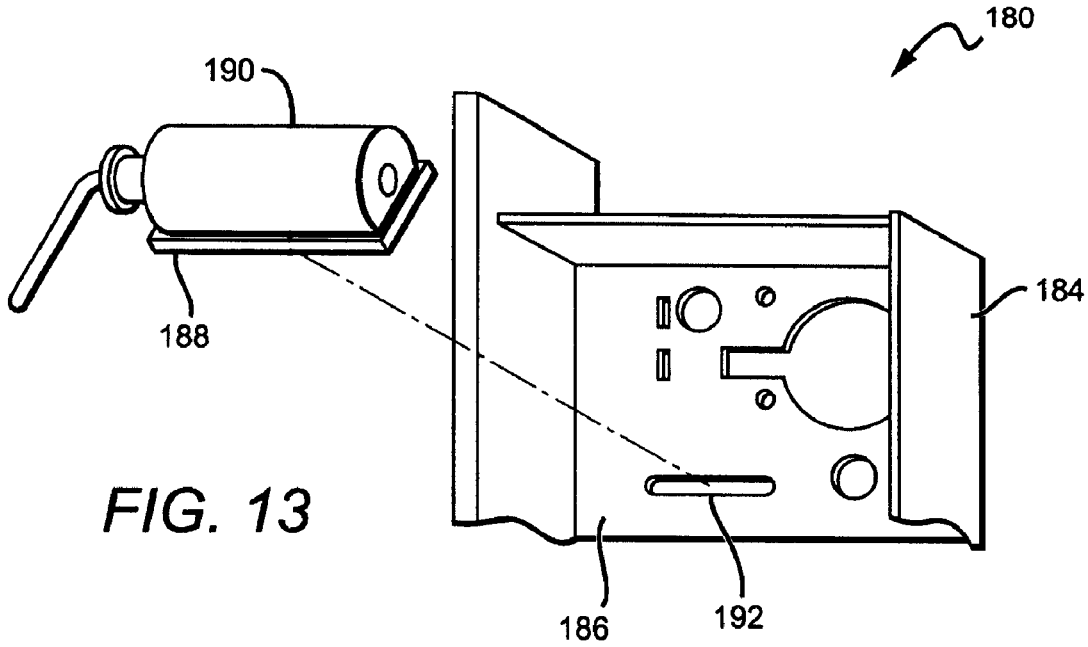
FIG. 13 is an exploded perspective view of another embodiment of a solenoid and cradle arrangement according to the present invention.
Figure 14:
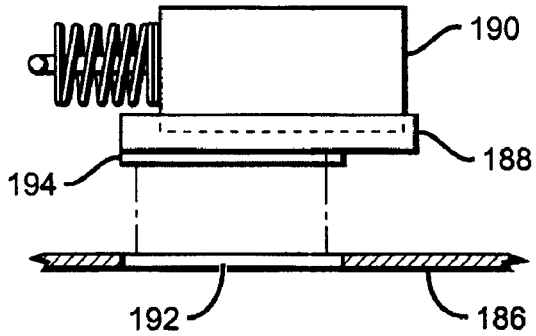
FIG. 14 is a side view of the solenoid and cradle arrangement of FIG. 13.
Figure 15:
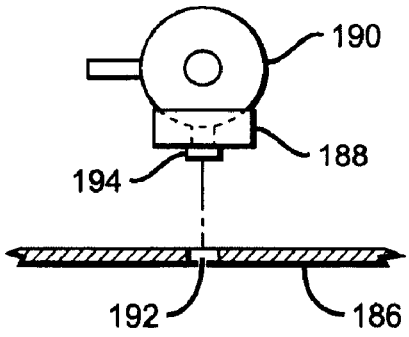
FIG. 15 is a end view of the solenoid and cradle arrangement of FIG. 13.
Figure 16A:
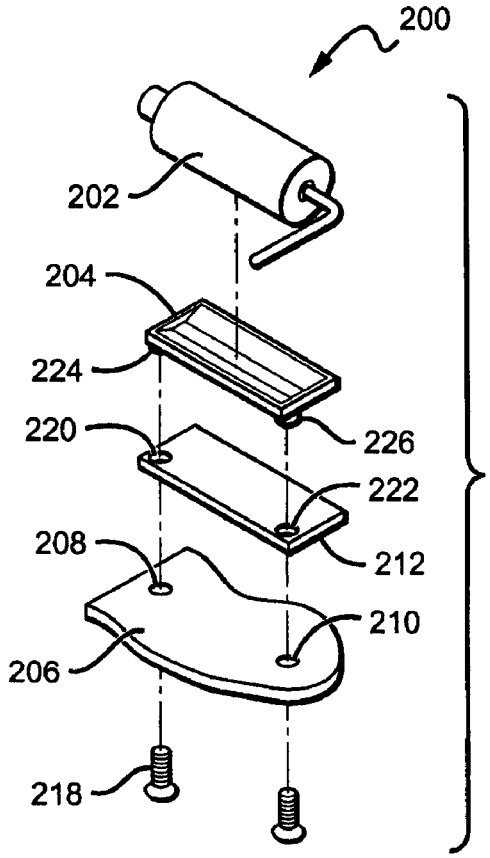
FIG. 16A is an exploded perspective view of still another embodiment of a solenoid and cradle arrangement according to the present invention.

FIGS. 13-15 show another embodiment of a solenoid assembly and cradle arrangement that can be used in a lock 180 according to the present invention. For ease of understanding and description the lock 180 is shown with only some of its components and in a partial cutaway. The lock 180 comprises a housing 184 with a back plate 186, a cradle 188 and a solenoid assembly 190 similar to the cradle 132 and solenoid assembly 100 described above. The cradle 188 is held in place at the back plate 186 and the solenoid assembly 190 is sized so that it fits within the cradle 188. The solenoid assembly 190 is then held between the surfaces of the cradle 188 and one of the surfaces of the housing 184, preferably the cover plate (not shown). The lock 180 illustrates still another arrangement for how the cradle is held in place according to the present invention. The back plate 186 comprises a cradle slot 192 and the cradle has a tab 194 sized to fit closely within the slot 192 when the cradle is positioned in the housing 184. When the solenoid assembly 190 is positioned in the cradle and the housing is assembled with its cover plate in place, the space within the housing is small enough that the solenoid assembly 190 is held in the cradle 188 and the tab 194 is held within the slot 192. The solenoid assembly 190 is accordingly held in place in the cradle 188 and the cradle 188 is held in place in the housing at the slot 192.

Figure 16B:
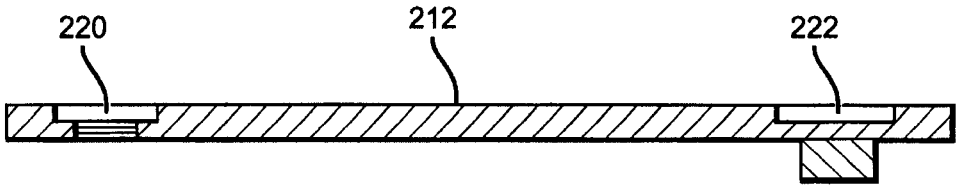
FIG. 16B is a cross-sectional view of the shim plate of FIG. 16A.

For locks where the space within the housing is not small enough to hold the cradle and solenoid in place, a spacer or shim plate can be used. FIG. 12 shows another embodiment solenoid and cradle arrangement 200 according to the present invention having a solenoid assembly 202 and a cradle 204. For ease of description and understanding only the cutout portion of the housing back plate 206 is shown, with the back plate 206 having first and second cradle holes 208, 210. A shim plate 212 is included that is arranged between the cradle 204 and the back plate 206, with the cradle a lower threaded hole and lower pin (show in FIG. 16B) that are spaced to align with the first and second back plate holes 208, 210. The pin is inserted into one of the holes, such as the second hole 210, and a screw 218 passes through the other of the holes, such as the first hole 208. The screw 218 is threaded into the lower hole and tightened to hold the shim plate 212 in place. The shim plate also has first and second upper holes 220, 222 and the cradle has first and second cradle pins 224, 226 spaced to be inserted into the shim plate holes 220, 222. When the components are mounted together and the housing is assembled, the space in the housing is small enough that the solenoid assembly 202 is held in the cradle 204, and the cradle is held on the shim plate 212. In other embodiments according to the present invention, the shim plate 212 can be held to the back plate 206 by other arrangements such as a slot and tab arrangement or double pin with double hole arrangement as described above.

Figure 17:
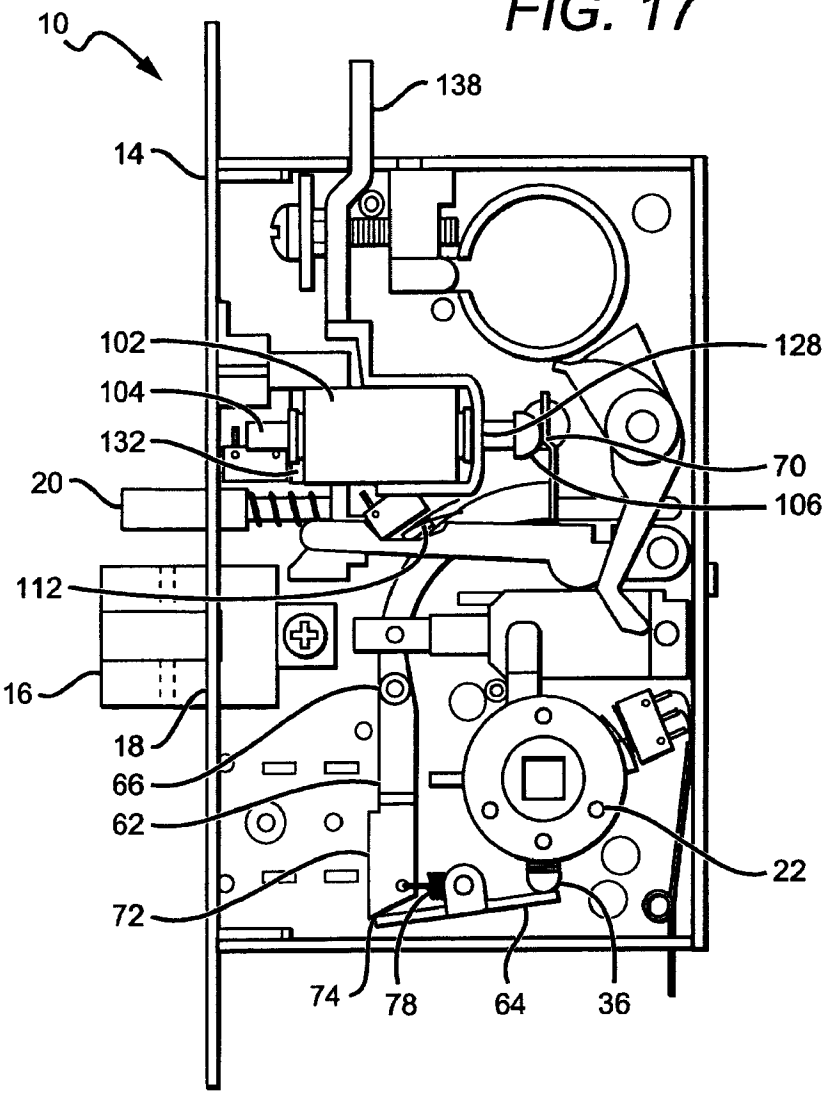
FIG. 17 is a plan view of the lock in FIG. 1, with power off.

FIGS. 1 and 17 show operation of the lock 10 in the fail safe mode with the solenoid body 102, plunger 104 and rod/tip assembly 106 arranged as shown in FIGS. 4-6. Power is applied to the lock 10 and solenoid body 102 over lock conductors 138, which supply an electrical signal to the solenoid electrical conductors 112 to energize the solenoid 102. The solenoid body 102 is nested in the cradle 132 and held in place such that the plunger 104 and rod/tip assembly 106 can operate on the locking lever 62. FIG. 1 shows the lock 10 with power applied such that the plunger 104 is drawn into the solenoid body 102 and the rod/tip assembly 106 extends from the first opening 128. The solenoid end 70 of the locking lever 62 is pushed toward the back of the housing by the rod tip assembly 106, which causes the locking lever 62 to rotate about the locking lever pin 66. This in turn causes the rocker arm end 72 of the locking lever 62 to move toward the front plate 14. This causes the rocker arm 64 to slide down the slider surface 74 and expand the rocker arm spring 78. In this position the rocker arm 64 allows the coupling member 36 to extend from the hub mechanism, effectively preventing the doorknobs 40,42 from retracting the latch bolt 16.

Referring to FIG. 17, when power to the solenoid body 102 is off or lost, the plunger 104 is free to slide within the longitudinal bore 108. The rocker arm spring 78 urges the rocker arm 64 to slide up the slider surface 74, which causes the rocker arm 64 to rotate about the rocker arm pin 76 and push in the coupling member 36. This action also causes the solenoid end 70 of the locking lever 62 to move toward the front plate 14 to push the rod/tip assembly 106 within the solenoid 102. With the coupling member 36 pushed in, the doorknobs 40,42 can turn the hub mechanism 22 to retract the latch bolt 16. This provides the fail safe operation of the lock wherein the door can be opened when power is off or lost.

Figure 18:
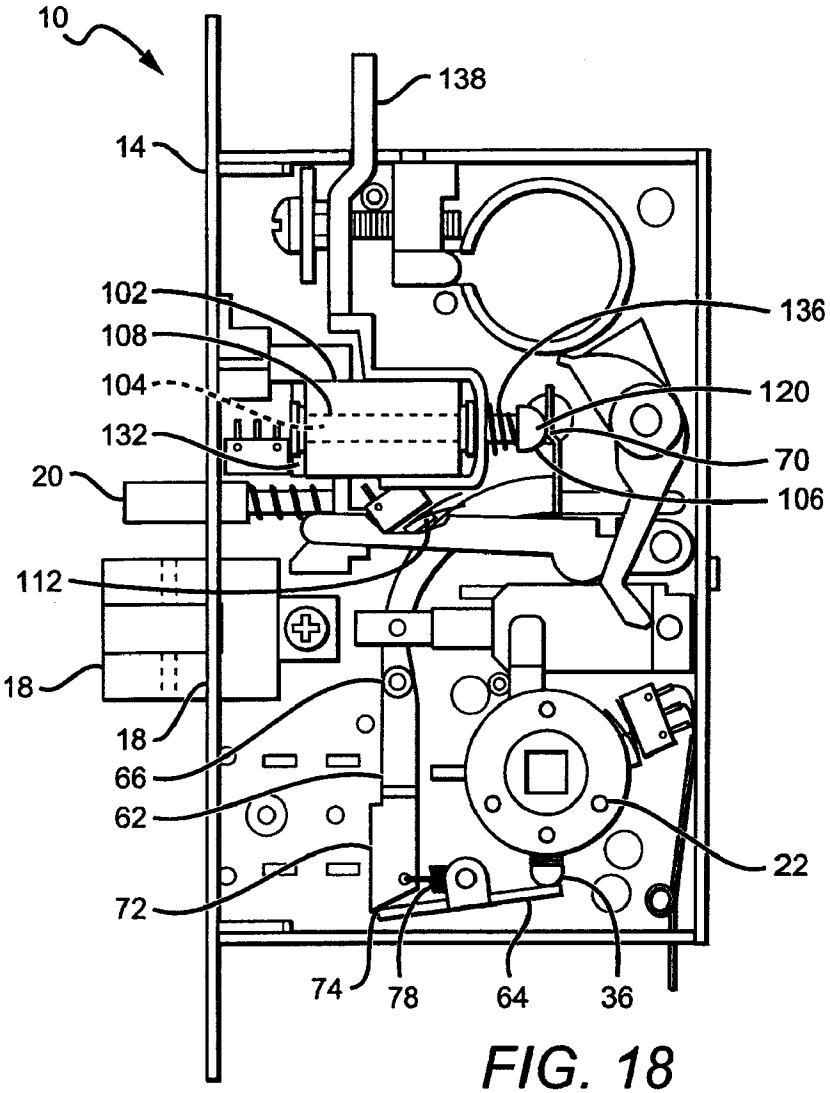

FIGS. 2 and 18 show operation of the lock 10 in the fail safe mode with the solenoid body 102, plunger 104 and rod/tip assembly 106 arranged as shown in FIGS. 7-9. In FIG. 2, the lock 10 is shown with power off or lost, which allows the plunger 104 to slide with the longitudinal bore 108. The solenoid spring 136 urges the plunger 104 and rod tip assembly 106 to extend from the second solenoid opening 130, to push the solenoid end 70 of the locking lever 62 toward the back of the housing 12. Through the action of the locking lever 62 and rocker arm 64, the coupling member 36 extends from the hub mechanism, which effectively prevents the doorknobs 40,42 from retracting the latch bolt 16. This arrangement provides a fail safe mode wherein the doorknobs 40,42 cannot open the door when power is off or lost.

In FIG. 10, the lock 10 is shown with power on such that an electric signal is applied to the solenoid body 102, which creates an electrical field that draws the plunger 104 into the longitudinal bore 108. This draws part of the rod/tip assembly 106 into the bore 108 and compresses the solenoid spring 136 between the hemispheric tip 120 and the solenoid body 102. This action allows the solenoid end 70 of the locking lever 62 to move toward the front plate 14, and the action of the locking lever 62 and rocker arm 64 to push the coupling member into the hub mechanism 22. This allows the doorknobs 40, 42 to retract the latch bolt 16.

One of the advantages of the present invention is that lock 10 can be quickly and easily changed to operate in either the fail safe or fail secure modes. If the lock 10 were arranged in the fail safe mode as shown in FIG. 1 the lock 10 can be changed to the fail secure mode by first removing the front plate of the housing 12. The solenoid assembly 100 can be lifted out its cradle 132 and the rod/tip assembly 106 can be turned out of the plunger 104. The solenoid body 102 is then turned 180 degrees and the spring 136 is placed over the second solenoid opening 130. The rod and tip assembly is then passed through the spring 136 and inserted into the opening in the plunger's bore 122 opposite the plunger's tapered end 114 and the lower threaded section 124 is threaded onto the plunger's threaded section 118. The solenoid assembly 100 is then placed back in the cradle 132 and the front plate is secured on the housing 12.

To change back to fail safe mode, the front plate is removed and the solenoid assembly 100 is lifted out of the cradle 132. The rod/tip assembly 106 is turned out of the plunger 104 and the spring 136 is stored. The solenoid housing is turned 180 degrees and the rod/tip assembly 106 is inserted into the first solenoid opening 128. The rod/tip assembly 106 is then turned onto the plunger's tapered end 114 and the solenoid assembly 100 is returned to the cradle 132. The cover plate is then secured on the housing 12.

Referring now to FIGS. 1 and 2, the lock 10 can also comprise switches 280*a-c* that can be activated depending on the condition of certain internal components of lock 10.

Switch 280*a* can be activated depending on whether the safety latch 20 is retracted, switch 280*b* can be activated depending on the position of locking lever 62, and switch 280*c* can be activated depending on the position of hub mechanism 22. The output of switches 280*a-c* can be sent to a security control center over conductors 138 and 139 so that the state of the lock 10 can be monitored.

The spring 136 can be arranged to provide advantages over the conventional springs that can improve both the performance and life of the lock 10. The preferred spring has a spring rate (ratio of load over distance of compression) that closely matches the power curve of the solenoid. The preferred spring can also be compressed without stacking of the turns of the spring, which helps prevent locking of the spring turns over other spring turns and allows the spring to compress to a very small height. This can be accomplished by springs having many different shapes.

Figure 19:
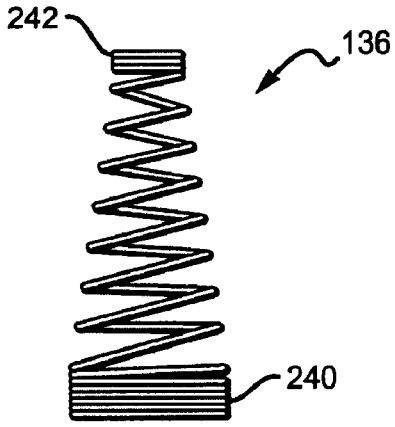
FIG. 19 is an elevation view of one embodiment of a conical spring according to the invention.

FIG. 19 shows one embodiment of a spring 136 according to the present invention wherein the diameter of the spring turns is the largest at the spring bottom 240 and smallest at the spring top 242. This arrangement allows the "spring rate" of the spring stroke to more closely match the power curve of a linear solenoid. A conventional linear solenoid generates less force at the beginning of its stroke, with the force increasing through the stroke. As the plunger 104 is drawn into the longitudinal bore 108, the force generated increases, which results in a non-linear solenoid "power curve".

Figure 20:
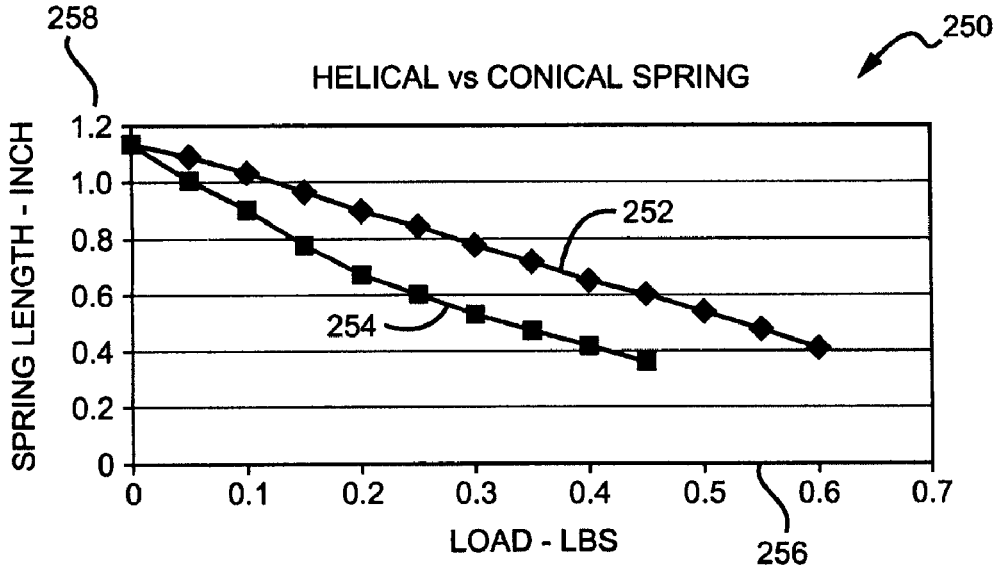
FIG. 20 is a graph showing the operation forces of a conical spring compared to a conventional helical spring.

FIG. 20 shows a graph 250 comparing the performance of a typical helical spring 252 and one embodiment of a spring 254 having a conical shape according to the present invention. The graph 250 shows the load generated 256 verses the spring length 258. A helical spring exerts an equal or linear force throughout its compression stroke. In comparison, the conical shaped spring exerts much less pressure at the beginning of its compression stroke compared to the end of the stroke. This provides the advantage of the conical shaped spring experiencing less stress on the spring material, which can result in the spring operating longer without a failure.

The conical shaped spring provides additional advantages related to the life of the solenoid assembly 100. When a helical spring is used to oppose plunger movement, the solenoid should be strong enough at the beginning of its stroke or power curve (the point where it is the least efficient) to compress the spring. The conical shaped spring can be arranged to more closely match/track the power curve of the solenoid such that when a conical shaped spring is used, a lower current solenoid can be used. Lower current allows the solenoid to operate at a cooler temperature and can extend the operational life of the solenoid.

The conical shape of a spring also allows the spring-to compress to a very small height. As the spring is compressed, each turn of the spring can be pushed into the spring below, instead of stacking (as best shown in FIG. 8) on the turn below as occurs in helical springs. A fully compressed conical shaped spring can compress to a height as small as approximately one turn of the spring.

The lock 10 also comprises an improved latch bolt arrangement that can prevent latch bolt damage compared to prior latch bolts. Prior latch bolts utilize a holding plate as a retractor to align the latch bolt. When excessive torque is applied to the hub mechanism in the reverse of its intended operational direction, the internal components of the lock are damaged and cause the lock to fail.

Figure 21:
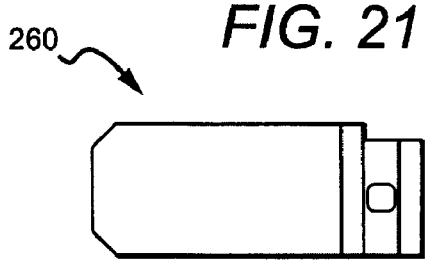
FIG. 21 is a plan view of one embodiment of a latch bolt according to the present invention.
Figure 22:
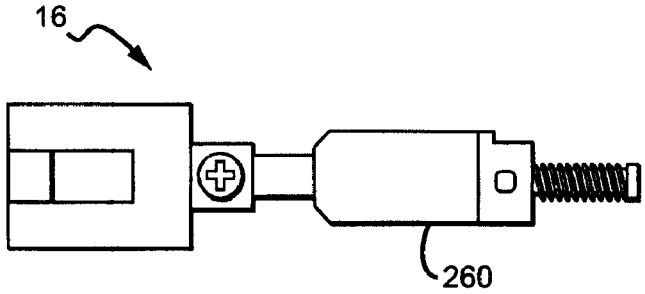
FIG. 22 is a plan view of one embodiment of a latch bolt retractor according to the present invention.

FIGS. 21 and 22 show one embodiment of a latch bolt 16 according to the present invention that comprises a retractor 260 that is shown in more detail in FIG. 22. The retractor 260 is elongated and keyed to the lock housing. This shape or the keying of the retractor allows the latch bolt finger 26 of the hub mechanism 22 (shown in FIG. 1) to float on top of the retractor without being actually connected to it. As shown in FIG. 1, the lock 10 comprises a metal post 261 that prevents the hub mechanism from rotating too far toward the front plate 14. However, there is no mechanism to prevent damage when the hub mechanism is rotated too far in the opposite direction. The retractor 260 is arranged to bypass the retractor when an excessive force is applied to the hub mechanism 22. This reduces the possibility of damage to the lock's internal components that could cause the lock to malfunction. The latch bolt 16 also comprises fewer parts compared to prior latch bolts, making the latch bolt 16 easier to manufacture and more reliable.

The retractor 260 can also be made of a material that melts at a certain temperature such that the lock 10 does not function, and the door cannot be opened after the temperature exceeds the temperature. One embodiment of a retractor 260 according to the present invention can be made of glass filled nylon that melts at a temperature of approximately 450 degrees. Glass filled nylon provides the additional advantage of being resilient and self lubricating to allow the latch finger to slide across it efficiently.

Although the present invention has been described in considerable detail with references to certain preferred configurations thereof, other versions are possible. The invention can be used in different locks described above. The steps taken above to interchange the lock between fail safe and fail secure modes can be taken in different order and different steps can be used. Therefore the spirit and scope of the claims should not be limited to the preferred version contained herein.

We claim:

1. An electric door lock that is interchangeable between fail safe and fail secure modes, comprising:

a housing for receiving the internal components of the door lock;

a latch bolt mounted at least partially within said housing and being movable between partially extended from and retracted into said housing;

a doorknob mounted to said housing and rotatable to retract said latch bolt;

said internal components comprising at least a solenoid assembly and a cradle, said solenoid assembly mounted within said housing that can be interchangeably arranged to cause said lock to operate in a fail secure or fail safe mode, wherein said cradle is held in place to the inside of said housing and said solenoid assembly is held in place within said cradle in both said fail safe and fail secure modes;

a shim plate between said cradle and said housing, wherein said housing further comprises first and second holes and said shim plate further comprising a mounting pin and a threaded hole, said lock further comprising a screw, said shim plate held in place within said housing by said mounting pin being inserted into one of said first and second holes, and said screw passing through the other of said first and second holes and turning into said threaded hole; and wherein said shim plate further comprises upper holes and said cradle further comprises pins, said cradle held to said shim plate by said pins being inserted in said upper holes.

2. The lock of claim 1, wherein said solenoid assembly is held in place between surfaces of said cradle and an inside surface of said housing.

3. The lock of claim 1, wherein said shim plate is held in place to said housing and said cradle is held in place to said shim plate, said solenoid assembly held within said housing between said cradle and an inside surface of said housing.

4. The lock of claim 1, wherein said solenoid assembly is nested within said housing without being affixed to said cradle or housing.

5. The lock of claim 1, wherein said solenoid assembly comprises a solenoid body, plunger and rod/tip assembly, said plunger mounted within and fully drawn into said solenoid body when said solenoid assembly is energized, said rod/tip assembly capable of being mounted to either end of said plunger to interchange said solenoid assembly between fail safe and fail secure modes.

6. The door lock of claim 5, wherein said plunger and rod/tip assemblies operate on said doorknob to allow operation in the fail safe or fail secure modes.

7. The door lock of claim 6, wherein said plunger and rod/tip assembly are arranged in the fail secure mode wherein said doorknob is prevented from retracting said latch bolt when said solenoid body is not energized.

8. The door lock of claim 6, wherein said plunger and rod/tip assembly are arranged in the fail safe mode wherein said doorknob is allowed to retract said latch bolt when said solenoid is not energized.

* * * * *